US007121767B1

(12) United States Patent
Watkins

(10) Patent No.: US 7,121,767 B1
(45) Date of Patent: Oct. 17, 2006

(54) RUGGED FOAM BUOYANCY MODULES AND METHOD OF MANUFACTURE

(75) Inventor: Lou W. Watkins, Stoughton, MA (US)

(73) Assignee: Cuming Corporation, Avon, CT (US)

( * ) Notice: Subject to any disclaimer, the term of this patent is extended or adjusted under 35 U.S.C. 154(b) by 0 days.

(21) Appl. No.: 10/294,455

(22) Filed: Nov. 14, 2002

Related U.S. Application Data

(60) Provisional application No. 60/332,250, filed on Nov. 14, 2001.

(51) Int. Cl.
*E21B 17/01* (2006.01)

(52) U.S. Cl. ..... 405/216; 405/211; 405/224.2; 166/350; 114/243

(58) Field of Classification Search ..... 405/224.1, 405/224.2, 211.1, 195.1, 211, 216, 171, 162, 405/158; 166/350, 367; 175/5–8; 114/243, 114/264

See application file for complete search history.

(56) References Cited

U.S. PATENT DOCUMENTS

| | | | | | |
|---|---|---|---|---|---|
| 3,707,434 | A | * | 12/1972 | Stayner | 428/313.5 |
| 3,729,756 | A | | 5/1973 | Cook et al. | 9/8 |
| 3,768,842 | A | * | 10/1973 | Ahlstone | 285/55 |
| 3,804,046 | A | * | 4/1974 | Kruger et al. | 114/50 |
| 3,893,201 | A | * | 7/1975 | Mallory | 441/1 |
| 3,939,509 | A | | 2/1976 | Moore | 9/8 |
| 3,996,654 | A | | 12/1976 | Johnson | 29/458 |
| 4,021,589 | A | | 5/1977 | Copley | 428/68 |
| 4,025,686 | A | | 5/1977 | Zion | 428/310 |
| 4,032,689 | A | * | 6/1977 | Johnson et al. | 428/55 |
| 4,040,165 | A | | 8/1977 | Miessler et al. | 29/458 |
| 4,057,450 | A | * | 11/1977 | Lee | 156/213 |
| 4,126,183 | A | | 11/1978 | Walker | 166/338 |
| 4,190,697 | A | * | 2/1980 | Ahrens | 428/309.9 |
| 4,314,384 | A | * | 2/1982 | Weinhaus | 441/68 |
| 4,398,487 | A | | 8/1983 | Ortloff et al. | 114/243 |
| 4,470,722 | A | | 9/1984 | Gregory | 405/195 |

(Continued)

FOREIGN PATENT DOCUMENTS

GB 2211462 * 7/1989

(Continued)

*Primary Examiner*—Frederick L. Lagman
(74) *Attorney, Agent, or Firm*—O'Shea, Getz & Kosakowski, P.C.

(57) ABSTRACT

A buoyancy module comprises a multi-layer outer protective shell that has an exterior surface and an interior surface. A first layer of foam buoyancy material is located adjacent to the interior surface. A second layer of foam buoyancy material that includes macrospheres and syntactic foam is surrounded by the first layer of foam buoyancy material. The multi-layer outer protective shell can include a layer of fiberglass backed by a fibrous plastic liner. In this embodiment, the layer of fiberglass provides the exterior surface of the multi-layer outer protective shell, while the fibrous plastic liner provides the interior surface of the protective shell. The second layer of foam buoyancy material can be a precast material. The precast material can include for example macrospheres and syntactic foam. The first layer of foam buoyancy material is preferably a stronger layer than the second layer of foam buoyancy material. Advantageously, the buoyancy module has a plurality of different layers, wherein the components of greatest strength and density are located on the outside. The multi-component system improves ruggedness of the buoyancy material, and provides increased reinforcement at locations subject to increased bending strengths, and provides a buoyancy module of longer life. In addition the buoyancy module may also include steel support members where bolting loads and other forces are brought to bear when parts are attached.

15 Claims, 2 Drawing Sheets

U.S. PATENT DOCUMENTS

| | | | | | |
|---|---|---|---|---|---|
| 4,474,129 | A | | 10/1984 | Watkins et al. | 114/243 |
| 4,477,207 | A | * | 10/1984 | Johnson | 405/195.1 |
| 4,608,403 | A | | 8/1986 | Sellstrom | 523/218 |
| 4,774,121 | A | | 9/1988 | Vollenweider, II | 428/117 |
| 4,903,358 | A | * | 2/1990 | Creyf et al. | 5/655.9 |
| 5,082,726 | A | | 1/1992 | Bastiaens et al. | 428/313.3 |
| 5,085,487 | A | * | 2/1992 | Weingartner et al. | 297/452.1 |
| 5,184,566 | A | * | 2/1993 | Cochran | 114/364 |
| 5,278,194 | A | | 1/1994 | Tickner et al. | 521/55 |
| 5,330,294 | A | * | 7/1994 | Guesnon | 405/224.2 |
| 5,722,340 | A | | 3/1998 | Sweetman | 114/243 |
| 5,900,195 | A | | 5/1999 | Pool et al. | 264/46.5 |
| 6,058,979 | A | | 5/2000 | Watkins | 138/149 |
| 6,153,294 | A | | 11/2000 | Patton et al. | 428/312.8 |
| 6,155,748 | A | | 12/2000 | Allen et al. | 405/195.1 |

FOREIGN PATENT DOCUMENTS

| | | | |
|---|---|---|---|
| JP | 07187065 | * | 7/1995 |
| WO | WO 01/14273 | | 8/2000 |

* cited by examiner

RUGGED FOAM BUOYANCY MODULES AND METHOD OF MANUFACTURE

CROSS REFERENCE TO RELATED APPLICATIONS

This application claims priority from the provisional application designated Ser. No. 60/332,250 filed Nov. 14, 2001 and entitled "Method for Making Syntactic Foam Buoyancy Modules of Superior Strength and Ruggedness". This application is hereby incorporated by reference.

BACKGROUND OF THE INVENTION

The invention relates to foam buoyancy modules, and in particular to multilayered/multi-component buoyancy modules with improved ruggedness.

The use of syntactic foam in buoyancy modules is well known. Buoyancy modules have generally included a single outer protective layer that surrounds a monolithic arrangement of syntactic foam. A problem with these prior art buoyancy modules is that they are susceptible to damage during handling and installation. For example, when buoyancy modules are used for risers in offshore oil rigs, the modules are often subject to extreme handling. Impacts to the modules can damage and/or fracture the single outer layer, and also damage the macrospheres within the single outer layer. Hence, prior art buoyancy material can often be damaged during handling and installation, which reduces their service life.

Therefore, there is a need for a buoyancy module of increased strength and ruggedness, and longer service life.

SUMMARY OF THE INVENTION

Briefly, according to an aspect of the present invention, a buoyancy module comprises a multi-layer outer protective shell that has an exterior surface and an interior surface. A first layer of foam buoyancy material is located adjacent to the interior surface. A second layer of foam buoyancy material that includes macrospheres and syntactic foam is surrounded by the first layer of foam buoyancy material.

The multi-layer outer protective shell can include a layer of fiberglass backed by a fibrous plastic liner. In this embodiment, the layer of fiberglass provides the exterior surface of the multi layer outer protective shell, while the fibrous plastic liner provides the interior surface of the protective shell.

The second layer of foam buoyancy material can be a precast material. The precast material can include for example macrospheres and syntactic foam. The first layer of foam buoyancy material is preferably a stronger layer than the second layer of foam buoyancy material.

Advantageously, the buoyancy module has a plurality of different layers, wherein the components of greatest strength and density are located on the outside. The multi-component system improves ruggedness of the buoyancy material, and provides increased reinforcement at locations subject to increased bending strengths, and provides a buoyancy module of longer life. In addition the buoyancy module may also include steel support members where bolting loads and other forces are brought to bear when parts are attached.

These and other objects, features and advantages of the present invention will become apparent in light of the following detailed description of preferred embodiments thereof, as illustrated in the accompanying drawings.

DETAILED DESCRIPTION OF THE INVENTION

Figure 1:
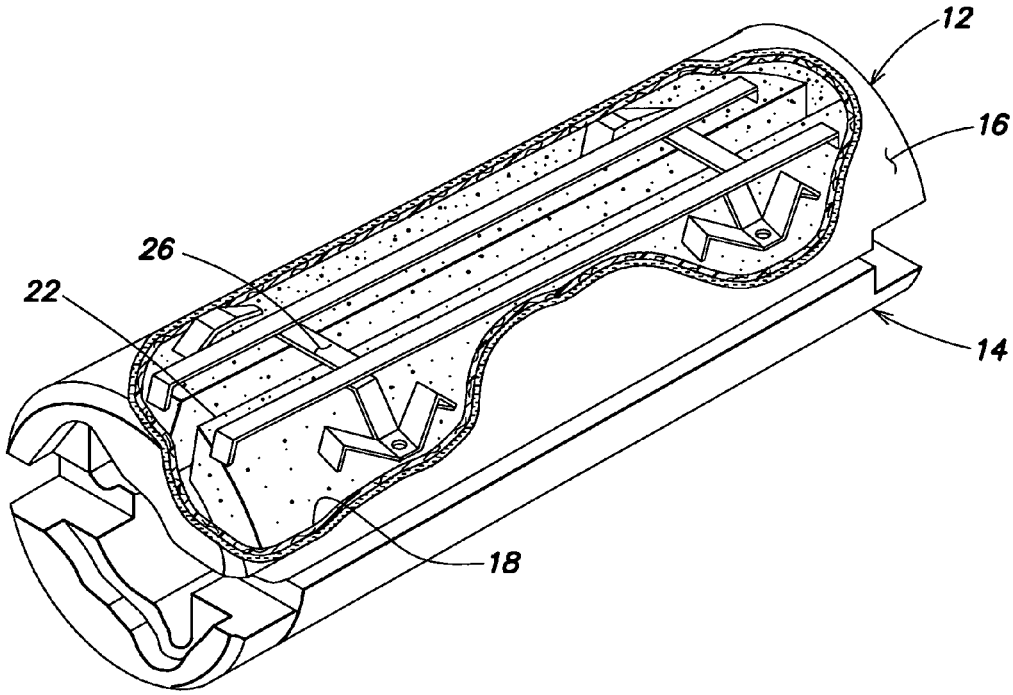
FIG. 1 is a partially cut-a-way illustration of buoyancy modules that can be mounted around a flowline.
Figure 2:
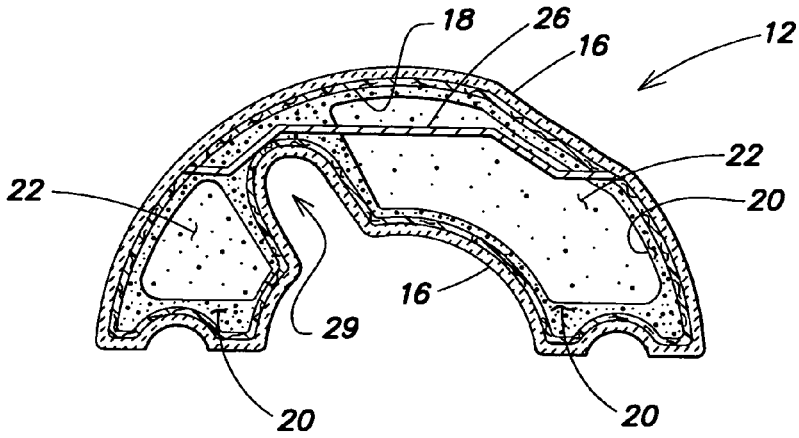
FIG. 2 is a cross-sectional illustration of the buoyancy module of FIG. 1.

FIG. 1 is a partially cut-a-way pictorial illustration of buoyancy modules 12, 14 that can be mounted around a flowline (not shown). FIG. 2 is a cross-sectional illustration of the buoyancy module of FIG. 1. Referring to FIGS. 1 and 2, each buoyancy module 12, 14 includes a fiberglass outer skin 16 (e.g., e-glass) that is backed by a fibrous plastic liner 18. The fibrous plastic liner 18 provides additional impact strength to the outer surface 16, and is preferably a tough elastic (e.g., stretchy) type of plastic that does not break. Therefore, even if there is a fracture of the fiberglass outer skin 16, the fibrous plastic liner 18 will not break and absorbs shock, thus preventing the fracture from increasing and holding the buoyancy modules' components together. The fibrous plastic liner 18 may include a non-woven random matted material made of nylon fiber. The liner 18 may be for example about 0.25 inches thick. The fiber is preferably a coarse (e.g., 1 mm in diameter) industrial grade fiber nylon matt. It is contemplated that other materials may provide the desired impact strength, such as for example, polycarbonate, polyethylene, high impact plastics such as for example styrene acrylonitile (SAN), acrylonityile butadiene styrene (ABS), et cetera. It is also contemplated that the fibrous plastic liner 18 may be replaced by a metallic liner, such as for example metal mesh, chain mail, et cetera. However, metal is rather heavy, so a preferred material is plastic.

The buoyancy modules also include buoyancy material, which includes a first layer of foam buoyancy material 20 located adjacent to the interior surface of the fibrous plastic liner 18, and a second layer of foam buoyancy material 22. The first layer of foam buoyancy material 20 may include macrospheres and a syntactic or non-syntactic foam. The second layer of foam buoyancy material 22 preferably includes macrospheres and syntactic foam, and is surrounded by the first layer of foam buoyancy material 20. However, the second layer of buoyancy material 22 may be a non-syntactic foam such as a gas filled foam. For example, the second layer of buoyancy material 22 may include a blown polyurethane foam or a PVC foam.

The second layer of foam buoyancy material 22 may be precast. In addition, the second layer of foam buoyancy material 22 is preferably less dense than the first layer of foam buoyancy material 20. That is, the second layer of foam buoyancy material 22 preferably has a higher packing factor than the first layer of buoyancy material 20.

Rather than a multilayer structure for the buoyancy material, a single layer of insulating material may be used. For example, the buoyancy material may be a single layer that includes macrospheres and syntactic foam.

The buoyancy modules may also include a metal or composite beam 26 that is integrally cast into the module at strategic points as required to increase structural strength. In addition, in critical areas, such as for example channel groove 29, the thickness of the fiberglass outer layer 16 may be increased (e.g., doubled). The channel groove 29 is used for various pipes that surround the riser—these areas of the buoyancy module are often subject to high stress.

Figure 3:
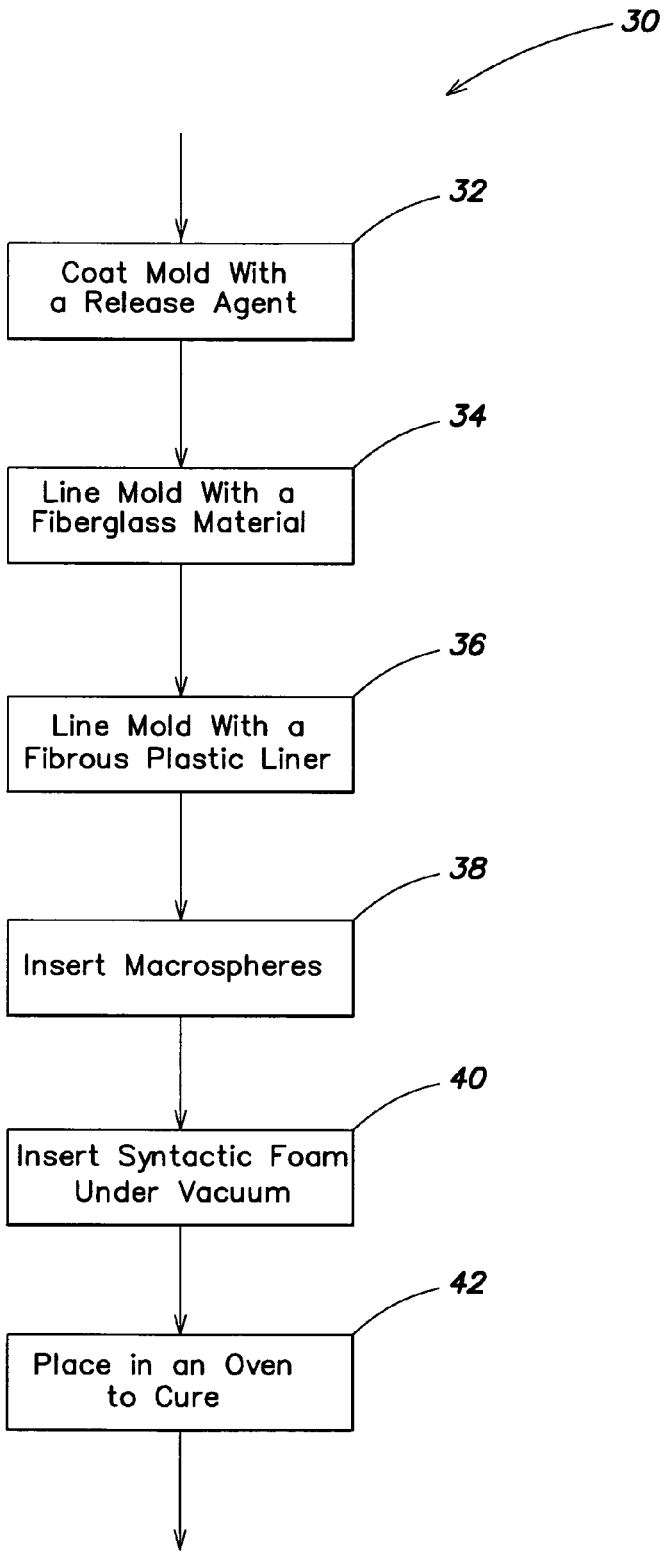
FIG. 3 is a flow chart illustration of a manufacturing process.

FIG. 3 is a flow chart illustration of a manufacturing process 30. The process includes step 32 in which a mold that provides a cavity the shape of which provides a positive shape of the object to be molded, is coated with a release agent. In step 34 the coated mold is then lined with a fabric fiberglass material 16. The mold is then lined with the liner 18 (FIGS. 1 and 2) in step 36. The fiberglass material 16 and the liner 18 are put in dry. The macrospheres are then introduced and vibrated to fill in all space in step 38. In step 40 syntactic foam is injected under vacuum to fill in all space between the macrospheres. The mold is then placed in an oven (e.g., for 4–8 hours at about 200 degs. F.) to cure in step 42.

Alternatively, the process for manufacturing buoyancy modules can include the multilayered buoyancy material as discussed hereinabove. In this step, the second layer of precast foam buoyancy material 22 is added and surrounds the first layer of foam buoyancy material. For example, the precast foam buoyancy material 22 can be added to the mold and positioned, for example with spacers. Macrospheres associated with the first layer of foam buoyancy material are then added to fill the space between the second layer of precast foam buoyancy material and the fibrous plastic liner 18. The syntactic foam is then added under vacuum to fill the spaces between the macrospheres of the first layer of foam buoyancy material, and the mold is then cured to form the buoyancy module. In addition, spacers 26 as shown in FIG. 1 may be added prior to the step of adding the macrospheres for increased module strength.

The buoyancy module may be used for riser modules, fairings, riser drag reduction devices, et cetera.

Advantageously, buoyancy modules of the present invention concentrate greater strength at peripheral surfaces to provide increased ruggedness, greater durability, longer life and damage resistance.

Although the present invention has been shown and described with respect to several preferred embodiments thereof, various changes, omissions and additions to the form and detail thereof, may be made therein, without departing from the spirit and scope of the invention.

What is claimed is:

1. A buoyancy module, comprising:

a multi-layer outer protective shell that has an exterior surface and an interior surface;

a first layer of foam buoyancy material that is located adjacent to said interior surface;

a second layer of foam buoyancy material, that includes macrospheres and syntactic foam that is surrounded by said first layer of foam buoyancy material.

2. The buoyancy module of claim 1, wherein said second layer of foam buoyancy material is precast.

3. The buoyancy module of claim 1, wherein said second layer of foam buoyancy material is precast and includes macrospheres and syntactic foam.

4. The buoyancy module of claim 1, wherein the thickness of said first layer of foam buoyancy material is substantially thinner than the thickness of said second layer of foam buoyancy material.

5. The buoyancy module of claim 1, wherein said multi-layer outer protective shell includes an exterior layer of fiberglass and an interior layer of a fibrous plastic.

6. The buoyancy module of claim 1, wherein said interior surface includes nylon non-woven material.

7. The buoyancy module of claim 1, wherein said interior surface includes nylon matted material having nylon fibers of about one millimeter in diameter.

8. The buoyancy module of claim 7, further comprising a lateral reinforcing member.

9. The buoyancy module of claim 8, wherein said lateral reinforcing member includes a metallic reinforcing member.

10. The buoyancy module of claim 4, wherein said buoyancy module is configured and arranged as a hemi-cylinder.

11. The buoyancy module of claim 1, wherein said multi-layer outer protective shell includes an exterior layer of fiberglass and an interior layer of a metallic material.

12. A subsea buoyancy module, said buoyancy module comprising:

a multi-layer protective shell that has an exterior surface and an interior surface, wherein said multi-layer outer protective shell includes, (i) a fiberglass outer layer that provides said exterior surface;

(ii) a fibrous plastic layer that provides said interior surface;

a first layer of foam buoyancy material that is located adjacent to said interior surface;

a second layer of precast foam buoyancy material that is encased by said first layer of foam buoyancy material.

13. The subsea buoyancy module of claim 11, wherein said second layer of precast foam buoyancy material includes blown polyurethane foam.

14. The subsea buoyancy module of claim 11, wherein said second layer of precast foam buoyancy material includes PVC foam.

15. The subsea buoyancy module of claim 11, wherein said second layer of precast foam buoyancy material includes syntactic foam.

* * * * *

UNITED STATES PATENT AND TRADEMARK OFFICE

CERTIFICATE OF CORRECTION

PATENT NO. : 7,121,767 B1
APPLICATION NO. : 10/294455
DATED : October 17, 2006
INVENTOR(S) : Lou Watkins It is certified that error appears in the above-identified patent and that said Letters Patent is hereby corrected as shown below:

Front Page, item (54)
In the title, delete "AND METHOD OF MANUFACTURE"

Signed and Sealed this

Ninth Day of January, 2007

JON W. DUDAS
*Director of the United States Patent and Trademark Office*